US005337692A

United States Patent [19]

Troiani

[11] Patent Number: 5,337,692

[45] Date of Patent: Aug. 16, 1994

[54] TRANSPARENT BOTTOM BOAT

[76] Inventor: Thomas C. Troiani, 614 Knob Hill Ave., Redondo Beach, Calif. 90277

[21] Appl. No.: 106,257

[22] Filed: Aug. 13, 1993

Related U.S. Application Data

[63] Continuation-in-part of Ser. No. 998,068, Dec. 23, 1992, abandoned.

[51] Int. Cl.[5] ..... B63B 5/24

[52] U.S. Cl. ..... 114/61; 114/357; 114/66

[58] Field of Search ..... 114/66, 355, 356, 357, 114/363, 61, 358, 360, 219; 441/135

[56] References Cited

U.S. PATENT DOCUMENTS

| | | | |
|---|---|---|---|
| 3,599,257 | 8/1971 | Erickson | 114/357 |
| 4,627,373 | 12/1986 | Nishida | 114/357 |
| 4,854,261 | 8/1989 | Goldsmith | 114/363 |
| 4,953,494 | 9/1990 | McClendon, Jr. | 114/357 |
| 5,000,106 | 3/1991 | Rheney | 114/66 |
| 5,086,725 | 2/1992 | Garrett et al. | 114/357 |
| 5,097,789 | 3/1992 | Oka | 114/363 |

*Primary Examiner*—Stephen P. Avila
*Attorney, Agent, or Firm*—John E. Halamka

[57] ABSTRACT

A recreational boat with a viewing plane which may be in contact with the water when the boat is ladened. The boat being constructed from two main pieces, a transparent hull piece formed with sponsons specially shaped to assist in maneuvering and a deck piece mated with the hull. The peripheral edges where the two major pieces are mated forms a splash guard and may be protected with a bumper. The deck is fabricated with seats, steering column, motor mount and storage compartment access doors. A second viewing plane may be formed in the bow of the hull and accessories such as a hand rail may be mounted on the deck.

16 Claims, 5 Drawing Sheets

TRANSPARENT BOTTOM BOAT

This is a Continuation in Part of Ser. No. 07/998,068 filed 23 Dec. 1992, which is abandoned upon the filing of this application.

BACKGROUND OF THE INVENTION

1. Field of the Invention

This invention relates generally to a boat fabrication method utilizing transparent plastic sheeting and results in a strong, water tight, see through hull.

2. Description of the Prior Art

Prior solutions to construct a transparent window in the hull of a boat have produced an awkward arrangement. The window is generally protected by a railing construct which prohibits passengers from walking on the window. As the window installed in the bottom of the boat is made larger to increase the viewing area, the usable walk space inside the boat becomes more restricted.

Further, the mounting of the window in the bottom of the boat has required the construction of a molding with peripheral seals to maintain the water tight integrity of the hull. This art is well known to construct glass bottom tourist boats used within controlled, quiet waterways. This art does not provide a solution for use of such a boat for public recreation use in open water such as lakes or oceans or uncontrolled rivers and streams.

However, even in quiet water, the shifting of load caused by use of the glass bottom boat eventually breaks down the integrity of the peripheral seal causing a leak and requiring down time of the boat for maintenance.

Further, glass has been the preferred window material because of its tensile strength and scratch resistance. But it is this combination of attributes which makes repair of scratches on the inside of the glass difficult to polish out to a reusable state.

The generally flat shape of the hull utilized in glass bottom boats is not suitable for recreation boats.

Prior solutions to glass bottom boats result in the transparent viewing area being maintained in contact with the water while the boat is stored in the water, even in and unburdened configuration. This contact with the water results in the formation of a film of algae on the viewing surface with obscurement of the view.

One prior attempt to solve the problems with a "glass boat" is described in U.S. Pat. No. 5,000,106. This solution teaches the use of forming mahogany structural members with plastic panels secured to the mahogany structural members by a unique method which prevents leaks. This method includes the generous use of silicone to achieve a seal. While silicone initially produces a seal, it does dry, shrink, and cold flow to compromise the seal. The teaching of sandwiching the plastic panels between inner and outer mahogany structural members promotes the cold flowing of the silicone promoting leaks or at least requiring ongoing maintenance to maintain a seal. Further, this patent teaches using LEXAN as the transparent panel. LEXAN cannot be used for any boat which is propelled by power means as LEXAN will dissolve in oil and gas and will be damaged by battery acid.

Thus, there has long been a need for an arrangement utilizing a transparent hull rather than simply embedding a window into part of the hull.

It is desired that the inside of the hull be able to withstand foot traffic and normal wear and tear without requiring extensive maintenance to maintain the clear window function.

It is further desired that the hull be shaped to be usable for recreational purposes. One configuration is to include a sponson in the hull. U.S. Pat. No. 5,086,725 teaches the use of a pair of sponsons (pontoons) but teaches that the inside panel of the pontoon should be fabricated at less than a 90 degree angle to the bottom of the hull. This configuration lacks the maneuverability demanded for recreational purposes.

SUMMARY OF THE INVENTION

Accordingly, it is an object of the present invention to provide an improved fabrication process which allows the formation of the entire hull from transparent material.

It is another object to eliminate the need for underwater peripheral seals to form the viewing plane window.

It is yet another object to provide an inside hull surface which withstands normal use with a minimum of maintenance.

It is yet a further object to provide a window boat with a hull shape which may be used in rough water recreational activity without the concern of causing leaks.

It is yet a further object to provide a hull shape which lifts the unladened boat so that the main viewing area of the hull is clear of the water whereby, formation of algae on the viewing area is prevented.

It is yet a further object to provide a hull shape which increases the maneuverability of the boat at speeds used by recreational users.

The above and other objects of the present invention are achieved, according to a preferred embodiment thereof, by providing an improved fabrication process to produce a transparent hull with an overlay deck sealed to the hull.

In the preferred embodiment, the application of the deck to the hull to form a peripheral seal of a preselected shape above the water line provides a waterproof viewing plane in a boat which may be used under rough water conditions without endangering the integrity of the seal.

In the preferred embodiment, the integration of sponsons into the hull allows the main viewing area of the hull of an unladened boat to maintain a clearance of approximately 1" above the water. This clearance prevents the growth of algae on the viewing area. A cargo of approximately 60 pounds closes this gap, places the viewing area in contact with the water, and permits direct viewing of any sea life under the hull.

The shape of the sponsons is selected to maintain structural integrity and to assist the high speed maneuverability of the boat by a recreational user.

The seal of the hull to the deck is formed as a downward curve thereby forming an integral splash guard around the periphery.

In another embodiment, after the peripheral seal is formed, a bumper is applied to enhance the integrity of the waterproof seal and protect the seal from being deformed during use or upon impact with a dock or object floating in the water.

Further, the bumper protects the sealed edges and joint which allows boat to be handled, launched and transported by conventional trailers rather than specialized equipment.

BRIEF DESCRIPTION OF THE DRAWINGS

The above and other embodiments of the present invention may be more fully understood from the following detailed description, taken together with the accompanying drawing, wherein similar reference characters refer to similar elements throughout, and in which.

DESCRIPTION OF A PREFERRED EMBODIMENT

Figure 1:
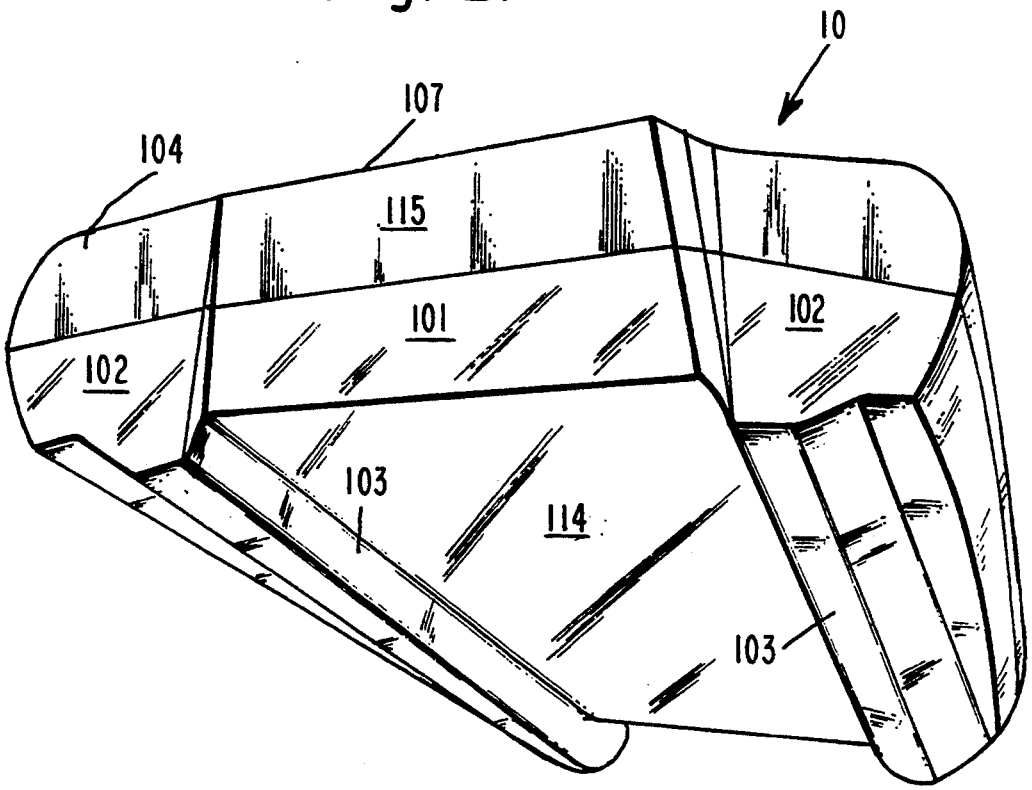
FIG. 1 is a perspective view of the preferred embodiment.

Referring now to the drawing, FIG. 1 shows the preferred embodiment of the boat 10 fabricated according to the invention.

The hull 101 may be unitarily fabricated from transparent sheet material. In the preferred embodiment, clear acrylic sheet stock of a preselected thickness, ranging from $\frac{1}{8}$ to $\frac{5}{8}$ inch, is formed by heating the sheet stock and applying it to a mold by means of vacuum form pressure to form a preselected shape.

Figure 7:
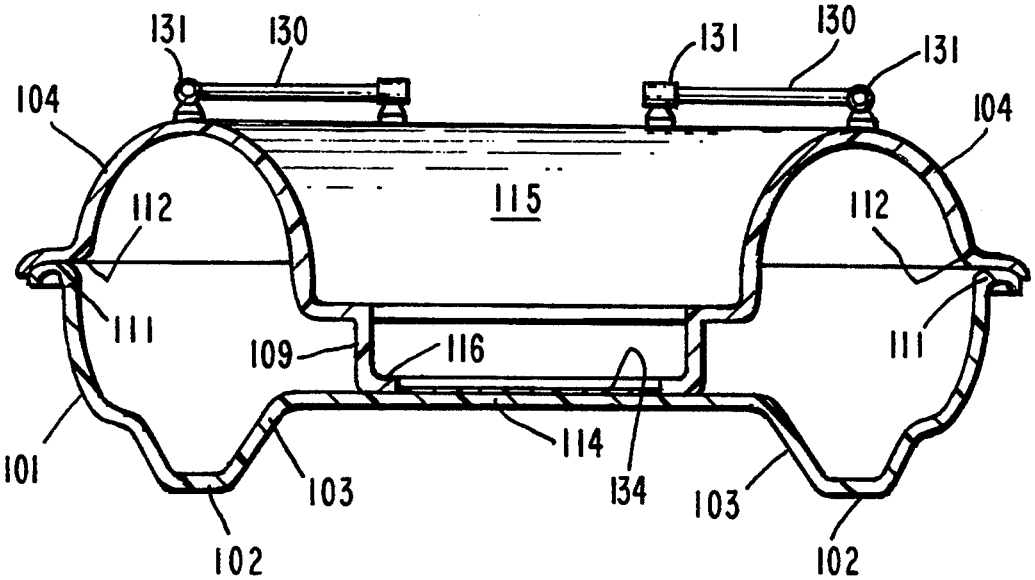
FIG. 7 is a cross sectional view of the hull.

The shape of the hull 101 in the preferred embodiment incorporates a plurality of sponsons 102 shown in detail in FIG. 7. The inside panel 103 of the sponsons 102 is formed at a preselected angle of 0.5 to 20 degrees from the vertical so that it forms an angle greater than 90 degrees with the bottom of the hull 101. The prior art teaches the formation of this sponson panel 103 in essentially vertical alignment to the hull or at an angle less then 90 degrees. The greater than 90 degree angle offset in the preferred embodiment allows the sponsons 102 to create greater lift, aids in maneuverability and safety of the boat and allows the one piece fabrication of the hull 101 without loss of strength or the requirement to add reinforcement at an abrupt bend in the plastic material. Added reinforcement at this juncture may distort the view through the hull 101, destroy the hydrodynamics of the hull 101 if added on the outside surface of the hull 101 and/or interfere with the fit of the deck 104 onto the hull 101 if added to the inside surface of the hull 101.

Figure 2:
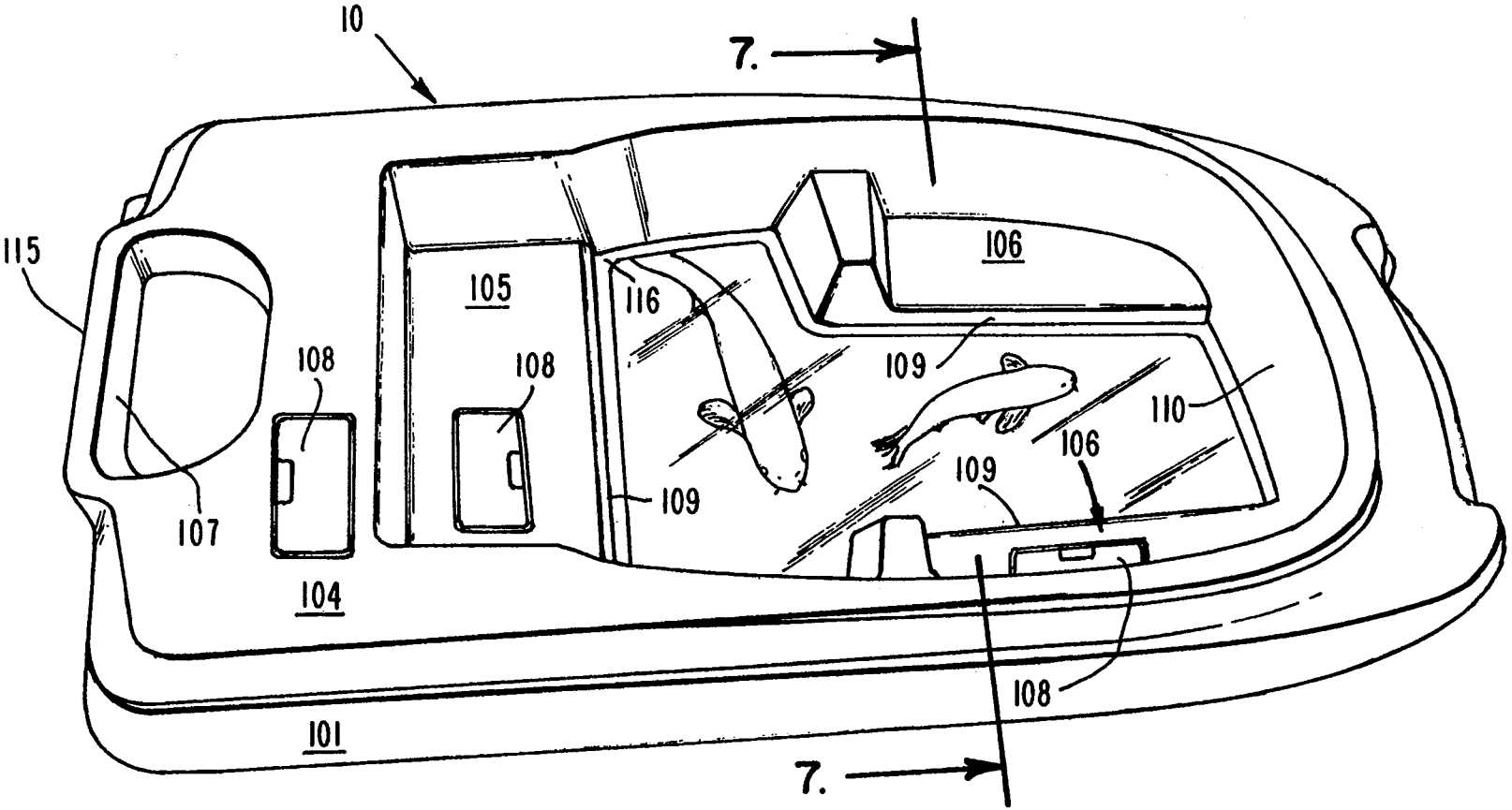
FIG. 2 is another perspective view of the preferred embodiment.

Now referring to FIG. 2, the deck 104 may be unitarily fabricated of non-transparent sheet material such as polyethylene in a manner similar to the formation of the hull 101.

The shape of the deck 104 in the preferred embodiment incorporates inboard seating for the user/driver 105, additional inboard seats for passengers 106 and outboard motor mount 107, and transom 115.

Preselected portions of the drivers seat 105 and passenger seat 106 may incorporate access doors 108 to allow storage of gear between the hull 101 and the deck 104.

The aft and forward portions of the deck 104 may also incorporate access doors 108 to provide additional storage of gear or closed cell foam flotation material as a safety measure to keep the boat afloat should it become swamped.

The shape of the hull 101 and deck 104 may be selected to accommodate the mounting of an inboard motor such as a jet drive.

A preselected area of the deck is formed as an aperture bounded in the front, rear and sides by the front panel 110 and the inboard kick plate 109 of the driver seat 105 and passenger seats 106.

The front panel 110 is formed a preselected distance from the bow of the boat. The sides of the aperture extend to intersect the inside surface of the hull 101.

Refering now to FIG. 1, the complete shape of the hull 101 incorporates a relatively flat viewing plane 114 between the sponsons 102. As shown in FIG. 7, the height of the inside panel 103 and the area of the sponsons 102 are preselected to provide sufficient displacement to allow the unladen boat 10 to sit in the water with the flat viewing plane 114 a preselected distance above the surface of the water. In the preferred embodiment, the flat viewing plane 114 sits about one inch above the water with the boat entirely empty. If the flat viewing plane 114 were in contact with the water during non-use of the boat, a film of algae may form on the viewing plane 114 and obscure the view when the boat is in use. The displacement of the sponsons 102 is further selected so that loading the boat with a cargo of approximately 60 pounds will be sufficient to bring the viewing plane 114 into contact with the water.

The upper surface of the hull 101 bounded by the edges of the pad 116 to form the viewing plane 114 in the deck 104 is subject to damage from foot traffic and movement of gear such as tackle boxes. It is recommended that passengers wear soft sole shoes and that all gear be appropriately stored so as not to shift.

However, should the inside surface of the hull 101 become scratched, the scratches may be rubbed out with a rogue or filled in with a coat of wax. Most of the scratches in the bottom of the hull 101 will be invisible once the viewing plane 114 comes into contact with the water.

FIG. 7 shows a protective insert 134 which may be inserted over the viewing plane 114. The insert 134 may be clear or opaque, stiff or flexible. If opaque, the insert 134 may be removed during use of the boat. If flexible, it may be rolled up and stored in a convenient compartment. The insert 134 could be fabricated as layers of clear material. If the outer layer should become damaged, it may be removed for disposal rendering the insert 134 clear and renewed.

Figure 3:
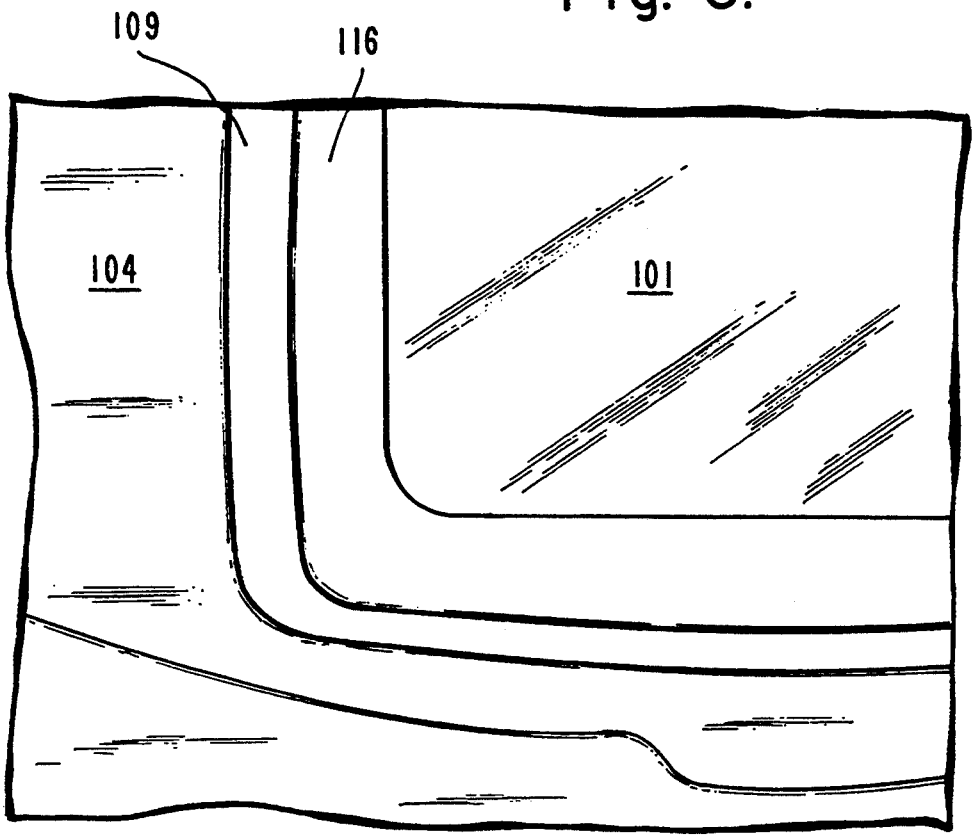
FIG. 3 is a partial view of the bottom side of the deck through the hull.
Figure 4:
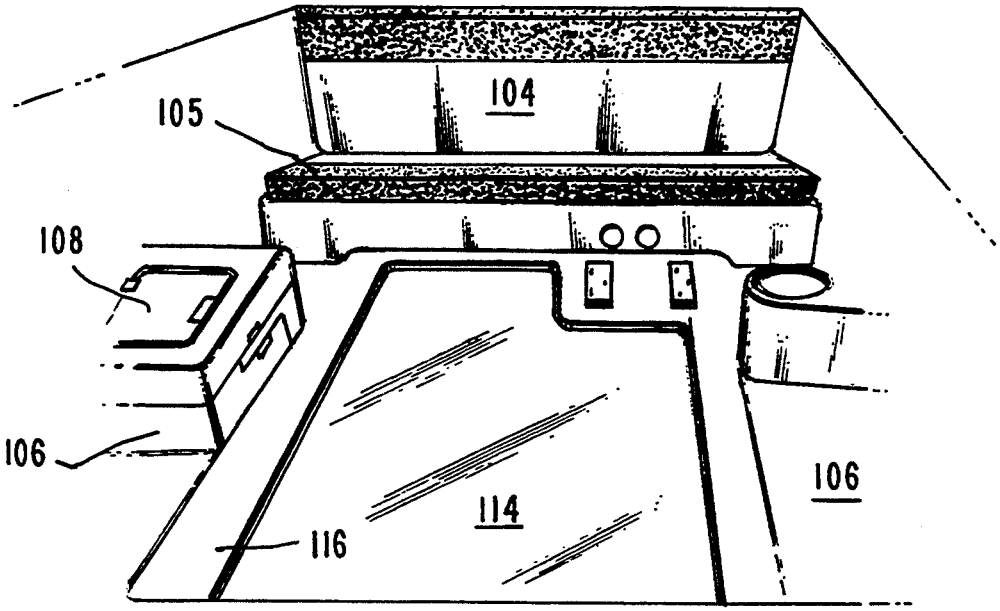
FIG. 4 is a perspective front view of the inside of the deck.

Now referring to FIG. 3, the bottom edge of the aperture sides extend to form a pad 116 of a selected width formed at essentially a ninety degree angle with the kick plate 109 and front panel 110. This pad 116, approximately 1 to 2.5 inches wide, is fabricated to form a surface congruent with the inside surface of the hull 101. The pad 116 may be attached to the hull 101 with adhesive, solvent, heat sealing or sonicly welded. The edges of the pad 116 form and define the viewing plane 114 of clear hull 101 visible by the user. A partial view of the viewing plane 114 is shown in FIG. 4.

The result is an integrated boat taking full advantage of the structural reinforcement gained by the joining of the hull 101 and the deck 104 to form a seaworthy recreational boat.

Figure 5:
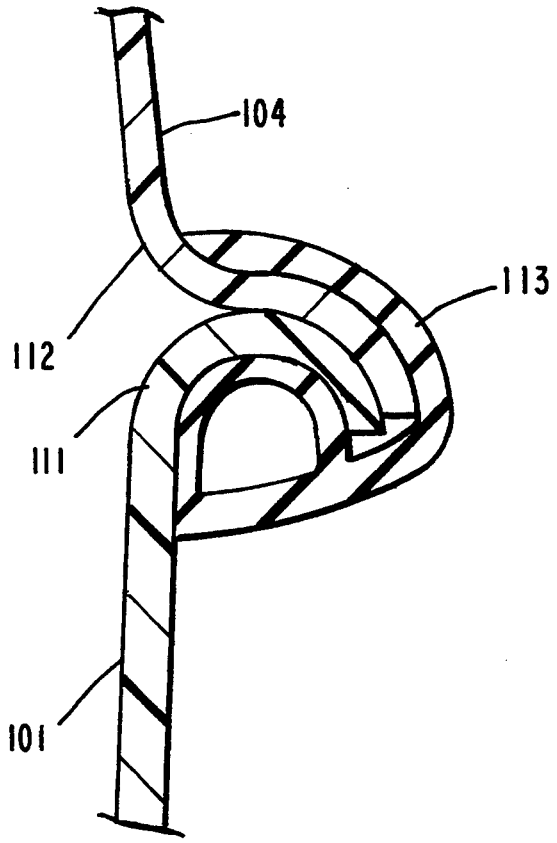
FIG. 5 is a cross section of the peripheral seal.

Now referring to FIG. 5, the outboard upper peripheral edge 111 of the hull 101 and the outboard lower peripheral edge 112 of the deck 104 are fabricated in a preselected curved shape whereby the deck 104 may be mounted on the hull 101. The upper peripheral edge 111 is formed a preselected distance above the viewing plane 114 so that even at maximum load, the upper peripheral edge 111 will be above the water line. The upper peripheral edge 111 and the lower peripheral edge 112 may be glued with a preselected solvent, adhesive, heat sealed or sonicly welded. The downward curved shape of the upper peripheral edge 111 forms a splash guard around the boat 10.

The entire peripheral edge may be protected by a flexible bumper 113 fabricated of high impact absorbing material. The bumper 113 adds an additional seal to the peripheral edge as well as providing a barrier to damage of the peripheral edge should the boat strike an object such as a pier piling or dock. The bumper 113 allows simple handling of the boat 10 without special harness or carrier.

Figure 8:
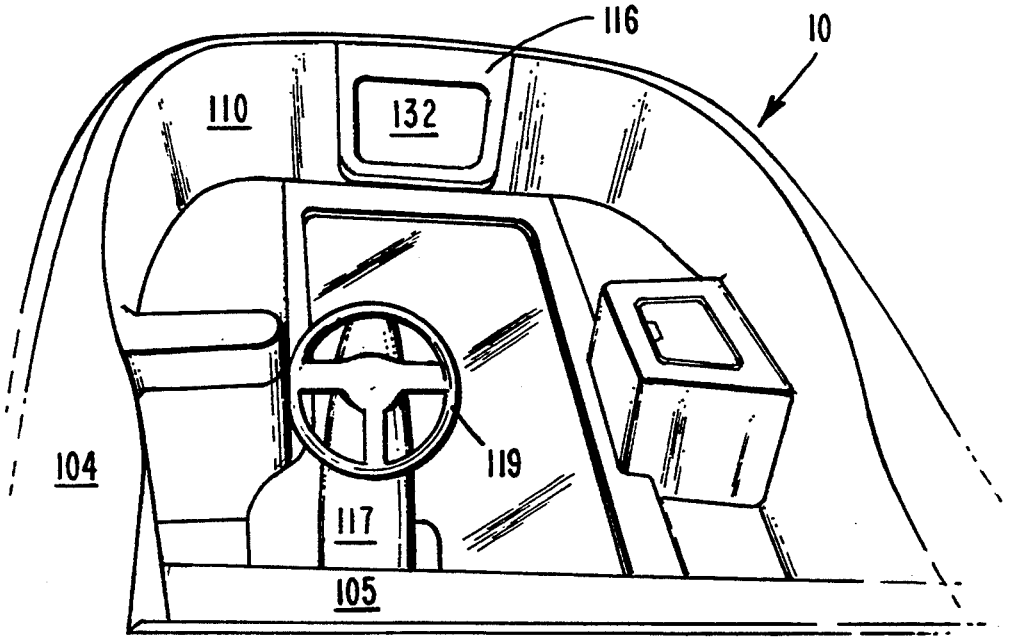
FIG. 8 is a perspective view of the front inside of the deck.

Now referring to FIG. 8, provision may be made in the deck to accommodate a steering wheel 119 and coupling means between the steering wheel 119 and the motor mount 107 whereby the attitude of the a propulsion device may be responsive to the rotation of the steering wheel 119. FIG. 8 also shows a steering column 117 fabricated as part of the deck 104 and extending from that portion of the kick plate 109 and pad 116 below the driver's seat 105. An access plate 118, shown in FIG. 6, allows installation and maintenance of the cables and pulleys that transmit the rotational position of the steering wheel 119 to the propulsion system of the boat 10 such as an out board motor mounted on the motor mount 107. The incorporation of the cables and pulleys inside the steering column 117 adds to the safe operation of the boat 10 without the danger of exposed rigging becoming entangled with cargo or passengers.

Figure 6:
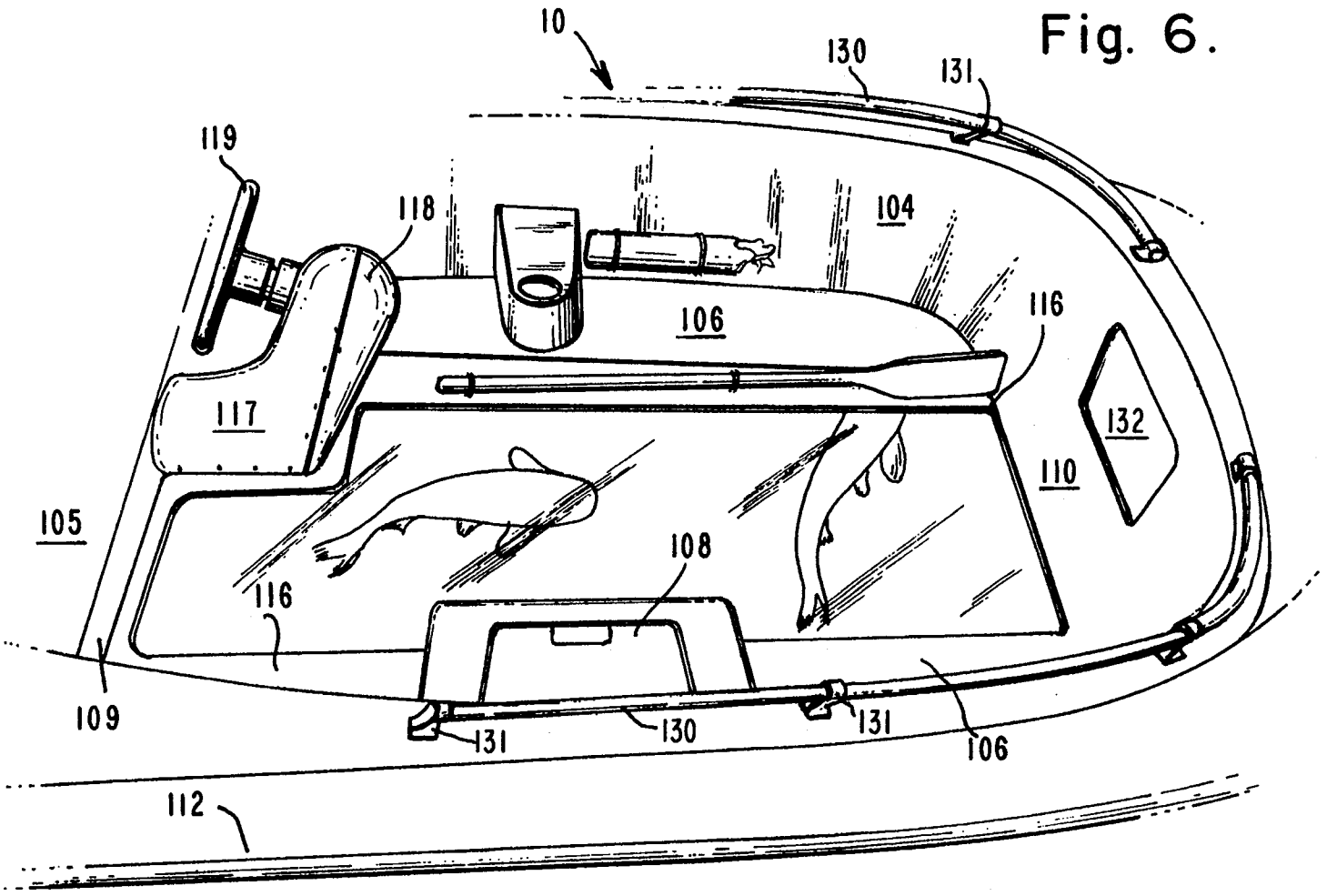
FIG. 6 is a perspective side view of the inside of the deck.

FIG. 6 also illustrates the installation of a plurality of stand-offs 131 upon which a railing 130 may be mounted. This railing 130 supplies hand holds for the users to stabilize themselves and convenient tie points for such items as safety lines and floats.

Navigating the boat in close quarters is made easier with the incorporation of a front viewing plane 132 into the deck 104. The structure of this front viewing plane 132 is similar to the main viewing plane 114 described above. The perimeter of the front viewing plane 132 incorporates a pad 116 extending from the edges of the front viewing plane 132, congruent with and sealable to the hull 101.

Since certain change may be made in the above apparatus without departing from the scope of the invention herein involved, it is intended that all matter contained in the above description, as shown in the accompanying drawing, shall be interpreted in an illustrative, and not a limiting sense.

What is claimed is:

1. A boat with a viewing plane which may contact the water comprising, in combination:

a unitarily fabricated, transparent hull having a substantially flat viewing plane, a plurality of sponsons adjacent said viewing plane, the inside panel of said sponsons being formed at a preselected angle from vertical to said viewing plane and an outboard upper peripheral edge a preselected distance above said viewing plane and the surface of said water;

a unitarily fabricated deck having an outboard lower peripheral edge congruent with and mounted on said upper peripheral edge and an aperture edge congruent with the inside surface of said hull forming a border for a preselected portion of said viewing plane.

2. The boat defined in claim 1 wherein:

the top edge of said outboard upper peripheral edge is formed in a downward curved shape forming a splash guard.

3. The boat defined in claim 1 wherein:

said deck further comprises a drivers seat and a plurality of passenger seats formed inboard of said deck lower peripheral edge.

4. The boat defined in claim 1 wherein:

said deck further comprises a motor mount and transom.

5. The boat defined in claim 1 wherein:

said hull and said deck are fabricated from material selected from the class consisting of ridged acrylic and polyethylene sheet material respectively in the range of approximately $\frac{1}{8}$ to $\frac{3}{4}$ inch thickness.

6. The boat defined in claim 1 wherein:

said deck further comprises openable closeable access doors hingedly attached to said deck whereby the user may place preselected items in the space between said hull and said deck.

7. The boat defined in claim 1 further comprising:

a bumper mounted over the joint formed by the attachment of said lower peripheral edge to said upper peripheral edge whereby said joint is protected from damage during handling, use and transport of said boat.

8. The boat defined in claim 1 further comprising:

a front viewing plane formed by a second inside peripheral edge congruent with the front inside surface of said hull framing said front viewing plane.

9. The boat defined in claim 3 wherein:

said inboard seats further comprises openable closeable access doors hingedly attached to said seats whereby the user may place preselected items in the space between said hull and said deck.

10. A boat with a viewing plane which may contact the water comprising, in combination:

a unitarily fabricated, transparent hull having a substantially flat viewing plane, a plurality of sponsons adjacent said viewing plane, the inside panel of said sponsons being formed at a preselected angle from vertical to said viewing plane and an outboard upper peripheral edge a preselected distance above said viewing plane and the surface of said water;

a unitarily fabricated deck having:

a. an outboard lower peripheral edge congruent with and mounted on said upper peripheral edge;

b. an aperture edge congruent with the inside surface of said hull forming a border for a preselected portion of said viewing plane;

c. a drivers seat formed inboard of said deck lower peripheral edge;

d. a plurality of passenger seats formed inboard of said deck lower peripheral edge; and, e. a front panel extending from the top surface of said deck to said hull a preselected distance from the bow of said boat;

a kick plate extending from the upper surface of said seats to said hull; and, a pad formed at a preselected angle to the lower edge of said front panel and kick plate, said pad being congruent with and attached to the inside surface of said hull.

11. The boat defined in claim 10 further comprising:

a steering column formed as an extension of said kick plate and said pad in front of said drivers seat.

12. The boat defined in claim 11 further comprising:

a steering wheel mounted on.. said steering column, being accessible to the user under the condition of the user seated on said driver's seat;

propulsion means mounted on said motor mount; and, control means routed through said steering column, communicating with said propulsion means whereby the attitude of said propulsion means is responsive to the rotational position of said steering wheel.

13. The boat defined in claim 12 further comprising:

an access plate mounted on said steering wheel whereby installation and maintenance may be performed on said control means.

14. The boat defined in claim 14 further comprising:

a plurality of stand-offs mounted on the upper surface of said deck; and, a railing mounted on said stand-offs providing accessible hand holds for the user.

15. The boat defined in claim 12 further comprising:

a steering wheel mounted on said steering column, being accessible to the user under the condition of the user seated on said driver's seat;

propulsion means mounted in said boat; and, control means routed through said steering column, communicating with said propulsion means whereby the attitude of said propulsion means is responsive to the rotational position of said steering wheel.

16. The boat defined in claim 10 further comprising:

a protective insert removably mounted inside said pad above the upper surface of said viewing plane thereby protecting said viewing plane from wear.

* * * * *